United States Patent [19]

Anthony

[11] Patent Number: 4,897,526

[45] Date of Patent: Jan. 30, 1990

[54] KILN AUTOMATIC POWER LEVEL SWITCHING AND DISPLAY MECHANISM

[76] Inventor: Frank Anthony, 326 Atherton Dr., Metairie, La. 70005

[21] Appl. No.: 133,973

[22] Filed: Dec. 17, 1987

[51] Int. Cl.[4] ..... H05B 1/02

[52] U.S. Cl. ..... 219/492; 219/493; 219/494; 219/506; 236/46 F; 373/136; 432/51

[58] Field of Search ..... 219/494, 491, 497, 499, 219/501, 505, 506, 508, 509; 236/15 BG, 46 F; 432/51, 32, 156; 373/136, 145, 148, 150

[56] References Cited

U.S. PATENT DOCUMENTS

| | | | |
|---|---|---|---|
| 2,700,505 | 1/1955 | Jackson | 219/493 |
| 2,788,416 | 4/1957 | Kilbury | 219/493 |
| 3,855,452 | 12/1974 | Flaza et al. | 219/492 |
| 3,901,437 | 8/1975 | Harkins | 219/492 |
| 4,184,067 | 1/1980 | Cress | 219/493 |
| 4,234,124 | 11/1980 | Yarrow | 219/493 |
| 4,367,399 | 1/1983 | Anthony et al. | 219/492 |
| 4,399,352 | 8/1983 | Ueda | 219/506 |
| 4,404,461 | 9/1983 | Sitek et al. | 219/492 |
| 4,705,930 | 11/1987 | Sathre, Jr. et al. | 219/492 |

*Primary Examiner*—M. H. Paschall

*Attorney, Agent, or Firm*—Nixon & Vanderhye

[57] ABSTRACT

A kiln firing cycle controller is disclosed which automatically cycles a hobbyist kiln through its low, medium, and high power level phases. The exemplary embodiment includes a control panel having a firing cycle initiating control knob. Manipulation of the control knob appropriately supplies power to the kiln's heating elements and energizes a motor. The control knob is mounted on a shaft which is rotated by the energized motor. Also disposed on this shaft are a plurality of cams which rotates and act in concert to interconnect a set of contacts which appropriately connect the heating elements to a power supply to thereby control the kiln's power level settings. The rotation of the cams also controls the timely energization of control panel low, medium, and high power level indicators.

24 Claims, 3 Drawing Sheets

FIG. 3
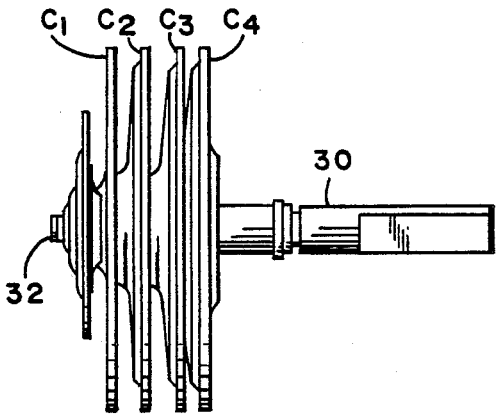
FIG. 4
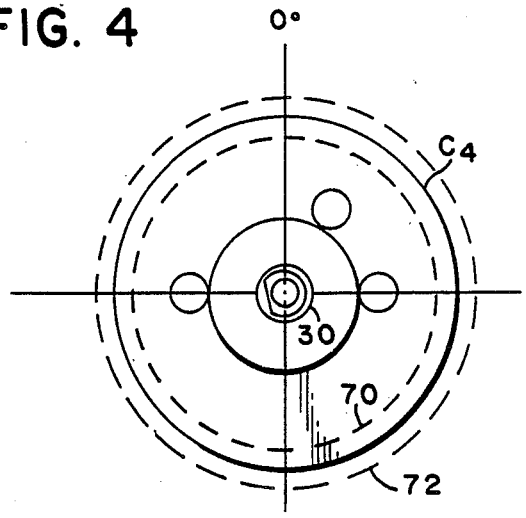
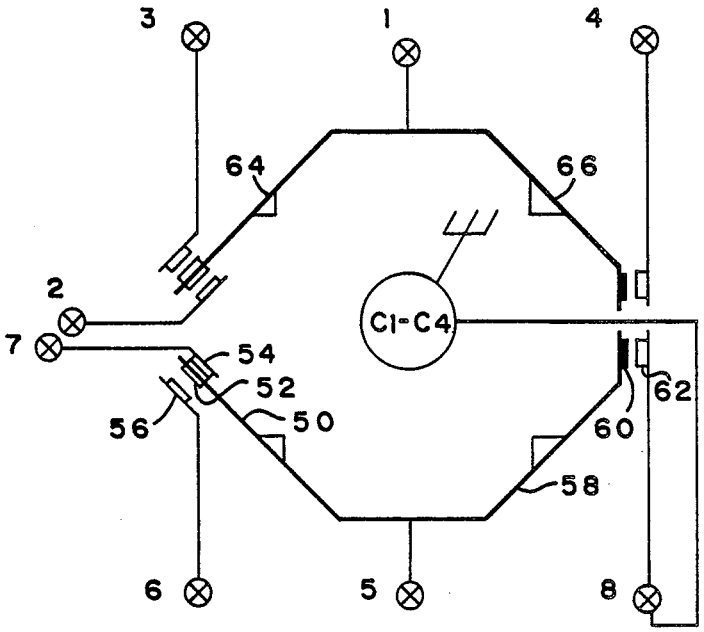
FIG. 6

KILN AUTOMATIC POWER LEVEL SWITCHING AND DISPLAY MECHANISM

FIELD OF THE INVENTION

This invention generally relates to firing cycle and temperature controlling devices for kilns. More particularly, the invention relates to a motor driven, cam actuated switching and timing mechanism which automatically cycles a household or hobbyist kiln through the low, medium, and high portions of a kiln firing cycle.

BACKGROUND AND SUMMARY OF THE INVENTION

"Kiln" is a term of art for designating a type of oven used for firing ceramic wares. A ceramic material, such as any member of that class of materials commonly designated as "clay", is wetted into a plastic mass and preshaped prior to being dried and then fired in the kiln into a permanently rigidized or sintered structure. After being subjected to the kiln's firing cycle, a fired object is usually somewhat smaller than its unfired counterpart, resulting in increased strength and density.

The present invention particularly relates to household or hobbyist kilns which are generally constructed much more cheaply than their commercial counterparts. In such kilns, the firing cycle is typically manually stepped by an operator from low to medium to high power levels by an operator controlled switch on a control panel of the kiln.

In order for the ceramic ware to fire properly it is necessary for an operator to manually step the manual switch from low to medium after the switch has been in the low position for an hour. One hour thereafter, the operator must return and step the manual switch from medium to high. Such kilns are typically equipped with a control device that detects when a specific kiln cycle end point temperature is reached. Upon detecting this temperature, a switch is tripped which shuts off the kiln to hopefully prevent or reduce the chance of overfiring.

Great care must taken by an operator to insure that the firing cycle progresses in accordance with power increases from low to medium after one hour at low power and from medium to high after one hour at medium power. In this regard, a ceramic ware prior to a kiln firing run has an undetermined amount of moisture within it. In the low power cycle, the ware is heated from room temperature to below the boiling temperature of water to rid the ware of moisture without boiling. If the moisture is boiled out of the ware, it is likely to crack.

For ceramic wares with a high degree of moisture content, more than hour may be required for this phase of the firing cycle. The shifting of the power level to medium power prior to the moisture being eliminated will initiate boiling and will likely cause cracking of the ware.

The medium power phase in the kiln firing cycle raises the kiln temperature to a point where the pliable clay material is rigidized into quartz crystal. This structural change occurs at a temperature on the order of 600° F.

The high power phase of the kiln firing cycle raises the kiln temperature such that the ceramic ware glaze completely melts to impart the desired color and texture to the finished product. Upon reaching or slightly exceeding the glaze firing temperature, which typically will be above 1200° F., the kiln will automatically shut off.

If an operator forgets to advance the operating cycle from low to medium, the kiln temperature remains at a point which is too low to initiate the quartz conversion phase noted above. Thus, assuming that the ware is moisture free, any excess time spent in the low power cycle translate directly into wasted power and increased operating expenses.

Similarly, any extra time that the kiln is maintained in the medium power phase does not serve to melt the glaze (which occurs in the high power phase) and likewise results in wasted energy and increased expenses. Accordingly, in order to produce a desired high quality ceramic ware in an economic fashion, it is necessary that the firing cycle be advanced on schedule.

In advancing through the firing cycle of a kiln, it is necessary to disconnect relatively large amounts of power. In this regard, some hobbyist kilns may draw as much as 60 amps of current.

Prior attempts to automate sequencing through the hobbyist kiln firing cycle have not been particularly successful. In order to automatically sequence through the high power level firing cycle of such a kiln requires electronic components whose expense cannot be cost justified. For example, in order to disconnect the high power levels in such a kiln would typically require large and expensive triacs. Moreover, in order to properly isolate such an electronic control circuit from the extreme heat generated in the kiln further increases the costs associated with such an electronic implementation. Additionally many electronic components do not perform very well under extreme heat conditions.

In order to circumvent costs associated with disconnecting relatively high power levels in the kiln, electronic control devices have heretofore been designed using a control switch, whereby the duty cycle is switched on for a predetermined percentage of the time and off for the remainder of the cycle to thereby control the power level. The successful operation of such electronic control devices depends on their ability to smoothly simulate a ramp function which gradually increases the power level from a low to a high setting.

Such electronic control devices (due perhaps to the large amount of heat generated within the kiln) have failed to accurately match the kiln firing cycle control achieved by an operator simply manually adjusting a control switch each hour. Correspondingly, the ceramic products generated by such automatically controlled kilns have failed to match the quality of the products generated by the manually operated hobbyist kiln.

The present invention utilizes a motor driven, mechanical switching mechanism which automatically advances the kiln firing cycle through the timing sequence that an operator was heretofore depended upon to move manually. Thus, the switching mechanism of the present invention insures that the kiln firing sequence includes accurately timed low, medium, and high cycles.

The automatic switching mechanism of the present invention allows for the production of high quality ceramic wares while requiring no manual intervention and while insuring that power is not wasted due to an operator's forgetfulness. The present invention also insures that the pottery produced is of a consistently high quality regardless of changes in kiln operators. Additionally, the automatic switching mechanism design of the present invention is not affected by the tremendously high temperatures within the kiln.

The present invention permits an operator to override the preprogrammed firing cycle by manually manipulating a control switch to modify the firing cycle, e.g., to maintain a particular ceramic piece in a predetermined phase of the operating cycle longer (or shorter) than if the kiln cycled automatically. If the switching mechanism is programmed for a relatively long phase of low power operation, an operator can rotate the automatic switching mechanism to shorten the low power phase, as desired.

The exemplary embodiment of the present invention, in addition to properly sequencing the kiln firing cycle, energizes low, medium, and high power level indicators on the kiln control panel to inform the operator as to the cycle the kiln is currently operating in.

The exemplary embodiment of the present invention includes a control panel having a firing cycle initiating control knob. Manipulation of the control knob appropriately supplies power to the kiln's heating elements and energizes a motor. The control knob is mounted on a shaft which is rotated by the energized motor. Also disposed on this shaft are a plurality of cams which rotate and act in concert to interconnect a set of contacts to thereby control the kiln's power level settings. The rotation of the cams also controls the timely energization of control panel low, medium, and high power level indicators.

BRIEF DESCRIPTION OF THE DRAWINGS

These and other objects and advantages of this invention will be more completely understood from the following detailed description of the presently preferred exemplary embodiment of this invention taken together with the accompanying drawings of which:

FIG. 3 is a side view of the cams and shaft assembly of the switching mechanism of the exemplary embodiment of the present invention;

FIG. 4 is a front view of the assembly shown in FIG. 3;

FIG. 6 is a schematically shows the physical disposition of the contacts shown in FIG. 2 within the switching mechanism of an exemplary embodiment of the present invention.

DETAILED DESCRIPTION OF THE DRAWINGS

Figure 1:
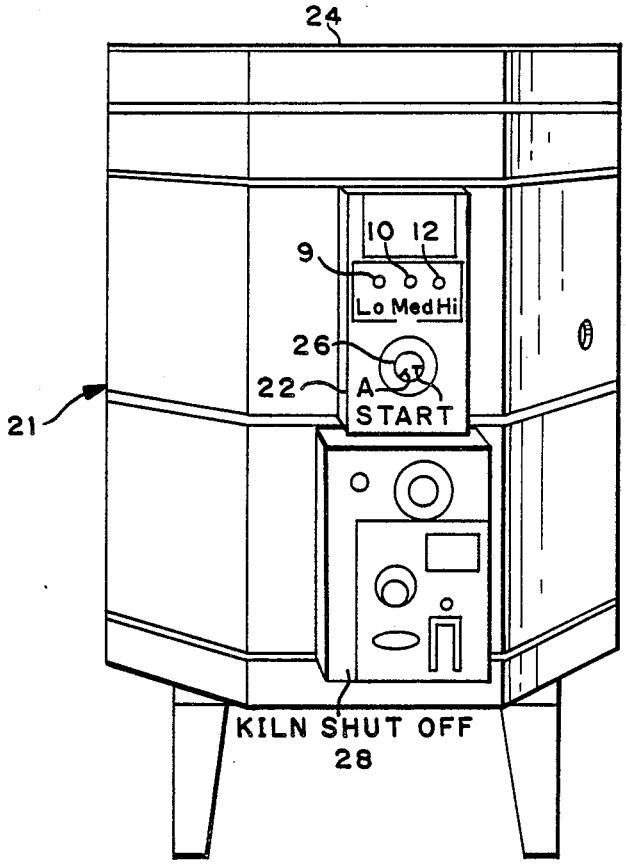
FIG. 1 is a front view of an exemplary kiln having a control panel including a firing cycle initiating control switch and power level indicators.

FIG. 1 schematically shows an exemplary kiln 21 whose firing cycle may be automatically controlled by the exemplary embodiment of the present invention described in detail below. Kiln 21 may by way of example only be a Blue Diamond (trademark of Blue Diamond Kiln Company, Inc., Metaire, La.) Model 180. This kiln has a top loading door 24 and an interior cavity which is octagonally shaped. The unit is electrically heated, drawing 24 amps at 240 volts. Although not shown in FIG. 1, the kiln 21 includes a heating cavity having the conventional refractory liner which lines the sides of the kiln 21 and which includes channels into which heating means such as resistive heating coils are placed.

In accordance with the present invention, the kiln 21 includes a control panel 22, the external portion of which is shown in FIG. 1. The control panel 22 includes a firing cycle initiating control knob 26 and low, medium and high power level indicator lights labeled 9, 10, and 12, respectively.

Actuation of switching mechanism 26 to the "START" position automatically initiates the kiln firing sequence of low, medium and high power level phases. As each phase is initiated the appropriate indicator light on the control panel 22 is energized. If the control knob 26 is rotated to the "A" position, the firing cycle is initiated at a point other than the beginning of the cycle, e.g., to thereby shorten the low power level phase. Control knob 26 may be, if desired, manually rotated to initiate operation at any predetermined point in the firing cycle. The kiln 21 is automatically turned off by a kiln shut-off mechanism 28 which, for example, may be a conventional Dawson Kiln Sitter.

Figure 2:
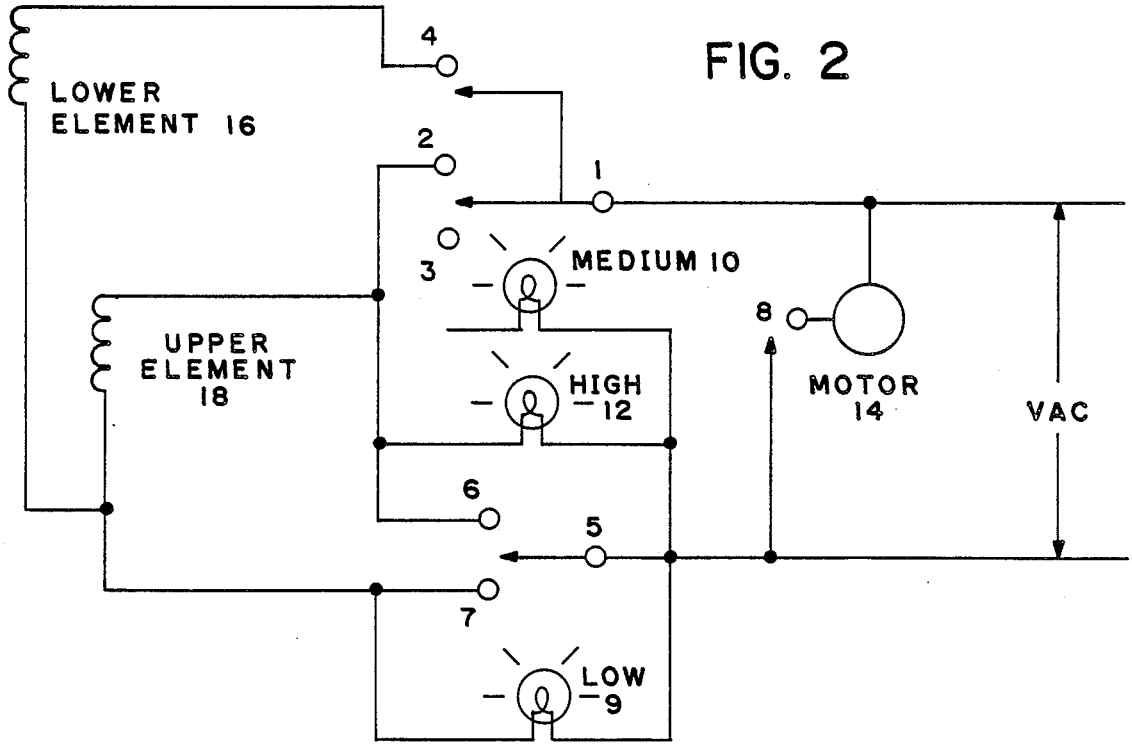
FIG. 2 is a schematic circuit diagram showing how the terminal contacts of an exemplary embodiment of the present invention are interconnected with the heating elements and the indicating lights.

FIG. 2 is a circuit diagram of an exemplary embodiment of a portion of the present invention showing how terminal contacts 1 through 8 are connected with each other and with the heating elements 16 and 18 and the indicator lights 9, 10 and 12. As shown in FIG. 2, AC voltage is provided to the circuit on common terminals 1 and 5.

The motor 14 shown in FIG. 2 functions to drive a set of four cams (as will be discussed in detail below) whose rotation connects or disconnects terminals 1 or 5 and the remaining terminals shown in FIG. 2. The motor 14 and the cams which serve to open and close the switches discussed below may be of the general type manufactured by the Mallory Timers Company as the Mallory M400 Series Interval Timer. The cams utilized to actuate the circuit shown in FIG. 2 must be "programmed" in accordance with the specifications to follow in order to properly control the kiln firing cycle.

With switch 26 of FIG. 1 in the off position, the contacts are open as shown in FIG. 2. When switch 26 is turned to the "start" position contact 8 closes, thereby energizing motor 14. Substantially simultaneously, contact 1 is connected with contact 4, and contact 5 is connected with contact 6. These switch closures serve to apply 220 volts AC to the lower element 16 and the upper element 18 in a series connection. Thus, as will be appreciated by those skilled in the art, such connections serve to initiate the low power level setting while illuminating the low power level indicator 9. Contacts 1 and 4 remain interconnected through the remainder of the firing cycle.

At the end of an hour (i.e., the expiration of the low power cycle), the cams as will be discussed below interconnect contacts 1 and 3 t turn on the medium power level indicator 10. At the same time, the interconnection between contacts 5 and 6 is opened, while the connection between 5 and 7 is closed. The interconnection of terminals 5 and 7 serves to short circuit the low power level indicator 9 and places the lower element 16 on full power by eliminating the series connection with upper element 18 to thereby initiate the medium power level setting.

After an hour in the medium power level setting, the rotation of the cams opens the connection between contacts 1 and 3, and closes the connection between 1 and 2 (while maintaining connection between contacts 5 and 7). The interconnection of contacts 1 and 2 while maintaining the connection between contacts 5 and 7 puts 220 volts across both elements, thereby initiating the full power setting (while also energizing the high pilot light 12 and turning off the medium pilot light 10). Shortly after the full power cycle is initiated, contact 8 is open circuited to thereby turn off the motor leaving the system in the full power mode until the kiln shut off device 28 shown in FIG. 1 shuts the power off.

Turning next to FIG. 3, this figure schematically shows a side view of the four cams C1 through C4, whose rotation opens and closes the connections between the contacts discussed above. The cams C1 through C4 are mounted on a shaft assembly 30 and are also connected to shaft 32 which is connected to drive motor 32.

The control knob 26 shown in FIG. 1 is connected to shaft 30 which can be utilized to mechanically rotate cams C1 through C4. In this fashion, an operator can position the cams to initiate any desired portion of the kiln firing cycle. Thus, if it were desired to start the kiln in the medium power setting such could be accomplished by mechanically rotating the control knob 26. The cams rotate together on shaft assembly 30 so that the programmed kiln firing order is preserved. Thus, the shaft may be either rotated manually by manipulating control knob 26 or driven by motor 14 by setting the control knob to "start" or some other motor driven setting.

FIG. 4 is a front view of FIG. 3 showing cam C4 which is mounted on shaft 30. The dotted concentric circles 70 and 72 represent reduced and extended diameter portions of cams C1 through C4 which function to close connections between the contacts 1 through 8 as will be discussed in detail below. The interconnections between the contacts shown in FIG. 2 and the rotating cams are preferably closed using spring biased switches or the like which open very rapidly. The cams C1 through C4 and their associated shaft assembly may be mounted within a conventional housing unit such as, for example, the housing unit utilized with the Mallory M400 Series Interval Timer.

Figure 5:
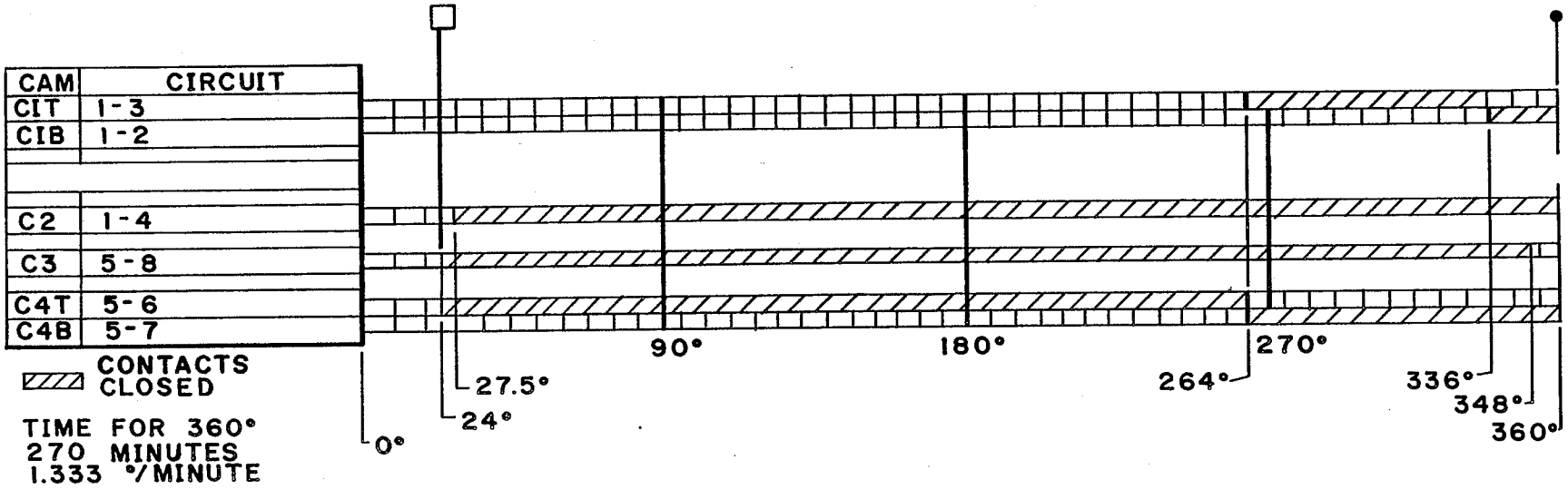
FIG. 5 is a timing chart showing how the rotation of the cams open and close the interconnections between the contacts shown in FIG. 2.

The manner in which cams C1 through C4 are programmed to control advancing through the kiln firing cycle is shown in the timing chart of FIG. 5. As noted above in regard to FIG. 2, the rotation of cams C1 to C4 opens and/or closes the interconnections between the terminals 1 through 8 shown in FIG. 2.

The timing chart of FIG. 5 shows which contact pairs 1 through 8 are interconnected or disconnected for each of the cams during 360° of cam rotation. Cams C1 and C4 each control the interconnection between two sets of contacts. Cams C2 and C3 control the interconnection between one set of contacts.

Cams C1 and C4 each have two entries in the timing chart labeled with a T and B, referring to designated top and bottom portions of the respective cams. These portions of each of cams C1 and C4 are designed such that the top of each cam has an extended diameter protrusion 72 (see FIG. 4) which forces a switch out away from the cam to make a connection with a particular contact. Along the bottom of each of cams C1 and C4 is a notched or reduced diameter portion 70 (see FIG. 4) which allows contact to be made with yet another terminal.

Thus, as shown in the timing chart, cam C1 is designed such that contact 1 is switched between terminals 3 and 2. Similarly, cam C4 is designed to switch contact 5 between contacts 6 and 7. Cam C2 interconnects only contacts 1 and 4 and cam C3 interconnects only contacts 5 and 8.

In the timing chart, where there is no cross-hatching the cam is not interconnecting any two contacts but rather leaves the contacts in an open circuit position. The cross-hatching in the timing chart indicates that the contacts shown in the left hand portion of FIG. 5 are interconnected to thereby close a portion of the circuit shown in FIG. 2.

As indicated by FIG. 5, after the control knob 26 shown in FIG. 1 is rotated to the start position the cams are driven to begin rotating but do not function to interconnect any two contacts until cams C3 and C4 have rotated through 24°. At 27½° cam C2 interconnects contacts 1 and 4. By virtue of interconnecting contacts 5 and 8, 5 and 6, and 1 and 4, the low power cycle is initiated due to the series connection of heating elements 16 and 18 and the low power cycle indicator light 9 is turned on.

It is noted that by an operator turning switch 26 to the A position shown in FIG. 1, the cycle is initiated at the 24° rotation point shown in FIG. 5. The Mallory model 400 referred to above includes a clutching mechanism which permits both driving the cams manually and by motor.

As indicated in FIG. 5, cam C3 interconnects contacts 5 and 8 throughout nearly the entire operating cycle which indicates that the motor 14 is energized during this entire period. Cam C3 opens motor contact 8 after 348° of rotation. Since each of the remaining cams close circuit connections defining the high power level at this time, the high power portion of the operating cycle is maintained until the kiln shut off device 28 automatically shuts off kiln power.

At 264° of rotation, as indicated by the timing chart, contacts 1 and 3 are closed, 5 and 6 are opened and 5 and 7 are closed, thereby initiating the medium power level and turning on the medium power level indicator.

After 336° of rotation, cam C1 interconnects contacts 1 and 2, cam C4 interconnects contacts 5 and 7, while 1 and 4 remain interconnected. As explained in conjunction with FIG. 2, this initiates the high power cycle and turns on the high power level indicator 12. As noted above, the high power level setting continues after the motor 14 is de-energized and ends when the kiln power is shut off by kiln shut-off device 28.

FIG. 5 shows an extremely lengthy low power cycle. As noted above, such a low power cycle may be desirable in order to eliminate moisture from a highly moisture-ridden ceramic ware. Such a long low power cycle is not essential to the present invention and it is contemplated that cams may be programmed to generate a much shorter low power cycle.

In the exemplary embodiment shown in FIG. 5, the time for the cams to rotate 360° requires nearly four and one half hours, one and one third degree of cam rotation occurring during each minute.

Turning to FIG. 6, this diagram schematically shows the actual disposition of the contacts 1 through 8 within the switching mechanism of the exemplary embodiment of the present invention. The correspondence between FIG. 6 and the circuit diagram of FIG. 2 will be apparent after a review of the relationship between the contacts disclosed in each figure.

In this regard, as shown in FIG. 2, common contact 1 is shown in FIG. 6 as switchably connectable with contact 2 or contact 3. Similarly, FIG. 6 shows common contact 1 as being connectable with contact 4.

Likewise common contact 5 (as shown in FIG. 2) is depicted in FIG. 6 as being switchably connectable to either contact 6 or contact 7 and also connectable to contact B.

Cams C1 to C4 and their associated grounded motor are mounted in the center portion of FIG. 6 and are disposed to make or break the connections shown during rotation. Common contacts 1 and 5 are each physically disposed on the cams indicated in the timing chart of FIG. 5. Contacts 2 through 4 and 6 through 8 are stationary contacts.

For example, the arm 50 associated with contact 5 rides on cam C4 (as indicated in FIG. 5) and makes connections with contact 6 or contact 7. As cam 4 rotates when connector 52 reaches a reduced diameter notched section 70 of cam C4 (see FIG. 4), it falls into the notch and connects with connector 54 of contact 7 to thereby interconnect contacts 5 and 7 as shown in FIG. 6. On the other hand, when cam 4 is rotated and connector 52 reaches an extended diameter portion 72 of cam C4 (see FIG. 4), connector 52 will be pushed towards connector 56 to thereby interconnect contacts 5 and 6.

Cam 3 has arm 58 of contact 5 rotating therewith. At the time when it is required to turn motor 14 on via contact 8, cam 3 rotates to a point where connector 62 which is associated with contact 8 interconnects with connector 60 to thereby interconnect contacts 5 and 8 for the duration indicated in FIG. 5. Movable contact 1 is interconnected with its associated contacts 2, 3, and 4 in precisely the same fashion as described above regarding contact 5 and therefore will not be discussed further.

In order to more clearly appreciate how contacts are interconnected, reference is again made to FIG. 4. As noted above, arm 50 which is connected to contact 5 rides on cam C4. During the time period that contact 5 must be interconnected with contact 7, connector 52 fall into a notch 70 represented by the smaller diameter dotted line shown in FIG. 4. This dotted line 70 represents the closed connection between contacts 5 and 7. During the period within which contacts 5 and 7 are interconnected connector 52 of arm 50 rides in this smaller diameter notch 70.

When contact 5 is to be connected with contact 6, cam C4 includes an expanded diameter portion 72 which represents the on connection between 5 and 6. During the time period that 5 and 6 are interconnected, connector 52 of arm 50 of contact 5 rides on the extended diameter section 72 of cam 4. Finally, when no connection is to be made, connector 52 rides on the "normal" diameter portion of cam 4 represented by the outside solid circle in FIG. 4. The connector 52 of contact of 55 is disposed between the connectors associated with contact 6 and 7.

Thus, cams C4 and C1 include multiple layers 70 and 72 in order to perform their switching functions. Cams 2 and 3 which connect one of the common contacts 1 and 5 with a single other contact, need only have a single additional layer such as notched layer 70 shown in FIG. 4 to make their connections.

In regard to FIG. 6, it is noted that contact 5 and arms 50 and 58 are mounted such that arms 50 and 58, contact cams C4 and C3, respectively, as indicated by the timing chart shown in FIG. 5. Similarly, the arms 64 and 66 associated with contact 1 ride on cams C1 and C2, respectively, and are disposed below contact 5 and its associated arms 50 and 58. Other details regarding the general matter of interconnecting contacts via rotating cams may be gained by reference to the commercially available Mallory M400 Series Interval Timer.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A kiln firing cycle controller for controlling the temperature of a kiln while firing ceramic ware comprising:

means for initiating said firing cycle;

drive motor means, energized by said means for initiating, for rotating a shaft, first timing means coupled to said shaft for automatically setting said kiln at a low power level setting at a first predetermined time in said firing cycle;

second timing means coupled to said shaft for automatically setting said kiln at a medium power level setting at a second predetermined time in said firing cycle;

third timing means coupled to said shaft for automatically setting said kiln at a high power level setting at a third predetermined time in said firing cycle;

said first timing means including means for maintaining said low power setting for a period of time which substantially exceeds the time during which the medium power level or the high power level is maintained; and operator override means for varying at least the time period during which said low power level is set.

2. A kiln firing cycle controller according to claim 1, further including display means for indicating the current power level setting of the kiln.

3. A kiln firing cycle controller according to claim 2, wherein said display means includes a low power level indicator, a medium power level indicator and a high power level indicator.

4. A kiln firing cycle controller according to claim 1, further including a first heating element and a second heating element, wherein said first timing means including means for supplying power to said first and second heating elements connected in series.

5. A kiln firing cycle controller according to claim 1, further including a first heating element and a second heating element, wherein said second timing means includes means for supplying power to one of said heating elements.

6. A kiln firing cycle controller according to claim 1, further including a first heating element and a second eating element, wherein said third timing means includes means for supplying power to said heating elements connected in parallel.

7. A kiln firing cycle controller according to claim 1, further including a plurality of heating elements and power supply means;

switching means for connecting said power supply means in low, medium, or high power level configurations;

said first, second, and third timing means each including at least one rotating means for rotating with said shaft, each of said rotating means being coupled to said switching means to set said kiln in at least one of said low, medium or high power level.

8. A kiln firing cycle controller according to claim 1, further including a plurality of heating elements means, wherein said first timing means includes low power switch means for interconnecting said heating elements means in a low power level setting and a plurality of rotating means coupled to said low power switch means for actuating said low power switch means.

9. A kiln firing cycle controller according to claim 1, further including a plurality of heating elements means and wherein said second timing means includes medium power switch means for interconnecting said the element means in a medium power level setting, and a plurality of rotating means coupled to said switch means for disconnecting said low power level setting and for actuating said medium power switch means.

10. A kiln firing cycle controller according to claim 1, further including a plurality of heating element means, and wherein said third timing means includes high power switch means for interconnecting said heat element means in a high power level setting, and a plurality of rotating means coupled to said high power switch means for actuating said high power switch means.

11. A kiln firing cycle controller according to claim 1, wherein said first, second and third timing means each include a plurality of cams which rotate with said shaft and switch means actuated by said rotating cams for setting said kiln in the appropriate power level setting.

12. A kiln firing cycle controller for controlling the kiln to advance through low, medium, and high portions of a firing cycle while firing ceramic ware comprising:

means for initiating said firing cycle at any predetermined desired portion of said firing cycle;

drive motor means, energized by said means for initiating, for rotating a shaft;

timing means coupled to said shaft for advancing said firing cycle from a low power level setting to a medium power level setting to a high power level setting, said timing means including means for maintaining said low power setting for a period of time which substantially exceeds the time period during which the medium or the high power level is maintained, and operator override means for varying at least the time period during which said low power level is set; and display means actuated by said timing means for providing a visual indication of the kiln's current power level setting.

13. A kiln firing cycle controller according to claim 12, wherein said display means includes a low power level indicator, a medium power level indicator, and a high power level indicator.

14. A kiln firing cycle controller according to claim 12, further including a first heating element and a second heating element, and wherein said timing means includes means including means for supplying power to said first and second heating elements connected in series to automatically set said kiln at a low power level setting for a predetermined period of time.

15. A kiln firing cycle controller according to claim 12, further including a first heating element and a second heating element, wherein said timing means includes means for supplying power to one of said heating elements to automatically set said kiln at a medium power level setting for a predetermined period of time.

16. A kiln firing cycle controller according to claim 12, further including a first heating element and a second heating element, wherein said timing means includes means for supplying power to said heating elements connected in parallel to automatically set said kiln at a high power level setting for a predetermined period of time.

17. A kiln firing cycle controller according to claim 14, wherein said timing means includes low power switch means for interconnecting said first and second heating element in a low power level setting and a plurality of rotating means coupled to said low power switch means for actuating said low power switch means.

18. A kiln firing cycle controller according to claim 15, wherein said timing means includes medium power switch means for connecting power to one of said the first and second heating elements in a medium power level setting, and a plurality of rotating means coupled to said switch means for disconnecting said low power level setting and for actuating said medium power switch means.

19. A kiln firing cycle controller according to claim 16, wherein said timing means includes high power switch means for interconnecting said first and second heating elements in a high power level setting, and a plurality of rotating means coupled to said high power switch means for actuating said high power switch means.

20. A method of advancing a kiln through low, medium, and high portions of a firing cycle while firing ceramic ware comprising the steps of:

initiating said firing cycle at a predetermined desired portion of said firing cycle;

energizing a motor to rotate a shaft coupled thereto in response to said firing cycle being initiated;

advancing said firing cycle from a lower power level setting to a medium power level setting to a high power level setting via a timing means coupled to said shaft, said advancing step including the step of maintaining under the control of said timing means said low power level setting for a period of time which substantially exceeds the time during which the medium power level or the high power level is maintained; and controlling a display means by said timing means to provide a visual indication of the kiln's current power level setting.

21. A method according to claim 20, wherein said controlling a display means step includes the step of actuating a low power level indicator, a medium power level indicator, and a high power level indicator.

22. A method according to claim 20, wherein said kiln includes a first heating element and a second heating element, and wherein said advancing step includes the step of supplying power to said first and second heating elements connected in series to automatically set said kiln at a low power level setting for a predetermined period of time.

23. A method according to claim 20, wherein said kiln includes a first heating element and a second heating element, and wherein said advancing step includes the step of supplying power to one of said heating elements to automatically set said kiln at a medium power level setting for a predetermined period of time.

24. A method according to claim 20, wherein said kiln includes a first heating element and a second heating element, and said advancing step includes supplying power to said heating elements connected in parallel to automatically set said kiln at a high power level setting for a predetermined period of time.

* * * * *